United States Patent [19]

Postma et al.

[11] Patent Number: 4,727,295

[45] Date of Patent: Feb. 23, 1988

[54] ELECTRODELESS LOW-PRESSURE DISCHARGE LAMP

[75] Inventors: Pieter Postma; Andreas C. van Veghel, both of Eindhoven, Netherlands

[73] Assignee: U.S. Philips Corporation, New York, N.Y.

[21] Appl. No.: 838,225

[22] Filed: Mar. 10, 1986

[30] Foreign Application Priority Data

Mar. 14, 1985 [NL] Netherlands ..... 8500737

[51] Int. Cl.[4] ..... H05B 41/16; H05B 41/24

[52] U.S. Cl. ..... 315/248; 313/493; 315/57; 315/85; 336/175

[58] Field of Search ..... 315/248, 57, 75, 344; 313/493; 336/175, 176

[56] References Cited

U.S. PATENT DOCUMENTS 3,521,120 7/1970 Anderson ..... 315/57

4,455,508 6/1984 Wesselink ..... 313/493

*Primary Examiner*—Saxfield Chatmon

*Attorney, Agent, or Firm*—Emmanuel J. Lobato

[57] ABSTRACT

An electrodeless low-pressure discharge lamp comprising a glass lamp vessel sealed in a gas-tight manner and filled with a metal vapor and a rare gas, and a winding on a ferrite core. During lamp operation an electrical discharge is maintained in the lamp vessel by the winding connected to a high-frequency supply. The winding is surrounded by a thin-walled cylindrical metal body or layer which is electrically insulated from the winding, is interrupted at at least one area and is connected during operation of the lamp to one of the power mains conductors.

23 Claims, 1 Drawing Figure

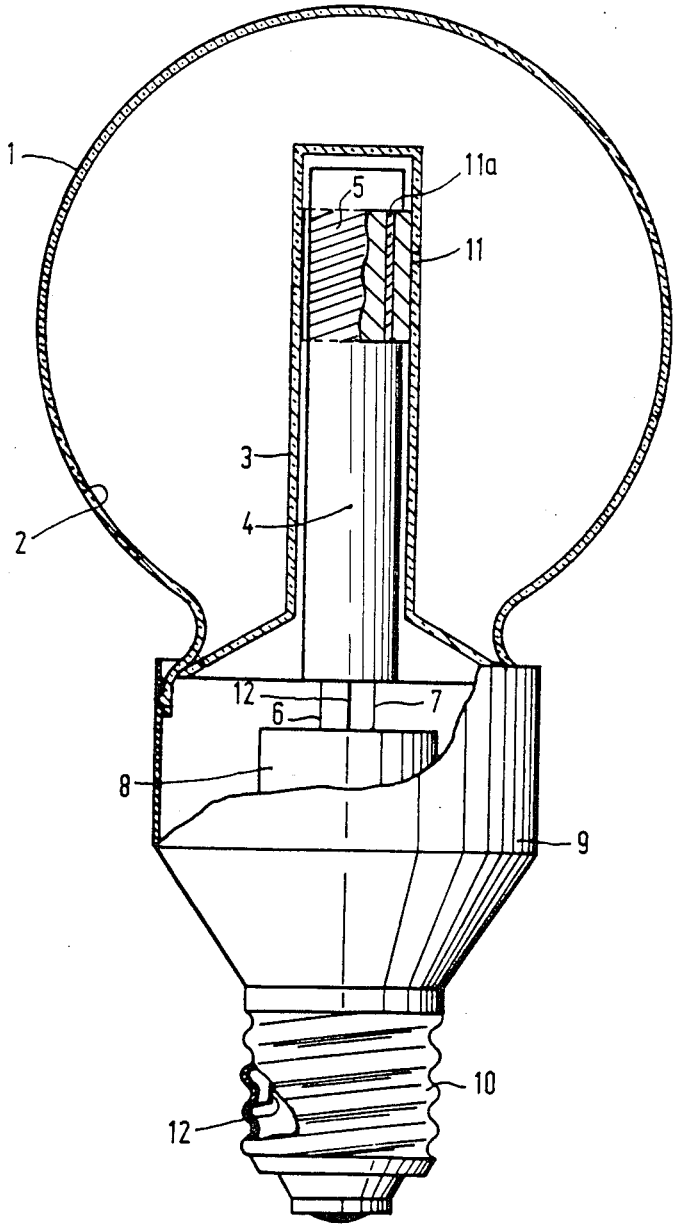
1
11a
5
11
3
4
2
12
6
7
8
9
10
12

ELECTRODELESS LOW-PRESSURE DISCHARGE LAMP

BACKGROUND OF THE INVENTION

The invention relates to an electrodeless low-pressure discharge lamp comprising a glass lamp vessel which is sealed in a gas-tight manner and is filled with a metal vapor and a rare gas. The lamp is provided with a core of magnetic material, while during operation of the lamp, an electric discharge is maintained in the lamp vessel by means of a wire winding connected to a high-frequency supply unit and arranged to surround the core. Such a lamp is known from Netherlands Patent Application No. 8301032 laid open to public inspection, and corresponding U.S. Pat. No. 4,622,495 issued Nov. 11, 1986.

The lamp described in this patent application has such dimensions that it can be readily screwed into a fitting for incandescent lamps. The supply unit in the lamp comprises a high-frequency oscillator circuit having a frequency higher than about 20 kHz. However, it has been found that during operation of the lamp high-frequency interference currents originating from the lamp are liable to be produced in the conductors of the supply mains. There is a risk that the lamp then no longer satisifes international standards imposed with respect to conducted interference currents.

The invention has for its object to provide an electrodeless low-pressure discharge lamp, in which the strength of the interference currents generated by the lamp in the conductors of the supply mains is reduced to a comparatively low level.

SUMMARY OF THE INVENTION

According to the invention, an electrodeless low-pressure discharge lamp of the kind mentioned in the opening paragraph is for this purpose characterized in that the winding is surrounded in its immediate proximity by a thin-walled cylindrical metal body which is electrically insulated therefrom, is interrupted throughout its length at at least one area and is connected during operation of the lamp to one of the lead-in wires of the supply mains.

A connection with the supply mains is to be understood herein to mean an electrical connection having a comparatively low-ohmic impedance, in which event high-frequency parasitic currents to the supply mains are shortcircuited. This can be realized by means of an electrical conductor directly connecting the metal body to a metal lamp cap or via an electrical connection between the body and the zero potential of a high-frequency supply unit for the lamp connected to the supply mains via a diode bridge.

In the lamp according to the invention during operation, the high-frequency electric interference at the supply mains is reduced to a comparatively low level.

The invention is based on the idea that the winding around the core is to be considered as an electrical voltage source having a given internal impedance which is connected to the mains conductors via parasitic impedances (such as a capacitance between the winding and the adjacent wall of the lamp vessel or between the lamp vessel and earth). With a thin-walled cylindrical metal body arranged to surround the winding in the immediate proximity, the said voltage source is shunted and a shortcircuit to the supply mains is obtained. Undesired interference currents at the supply mains are then avoided as far as possible. In the lamp according to the invention, the body is interrupted at one or more areas throughout its length in order to prevent excessive heating from occurring during operation and to avoid ignition problems of the lamp.

It should be noted that U.S. Pat. No. 3,521,120 discloses an electrodeless low-pressure discharge lamp having a rod-shaped core of magnetic material, in which the winding is surrounded by a cylindrical metal resilient sheath interrupted at one area. However, this sheath is not connected during operation of the lamp to one of the lead-in wires of the supply mains. The cylinder moreover extends throughout the length of the inner side of a tubular lead-through member in the lamp vessel, in which the core is accommodated. The cylindrical sheath serves as an auxiliary means for securing the lamp vessel to the housing which accommodates the high-frequency electrical supply unit. Nothing is stated about the use as an auxiliary means for suppressing interference currents to the supply mains.

In an embodiment of the lamp according to the invention, the thin-walled metal body is provided on the core itself at the area of the winding, a layer of electrically insulated material (such as synthetic resin or nylon) being situated between the body and the winding. Such a construction can be manufactured in a comparatively simple manner.

The wall of the lamp vessel is preferably provided with a tubular protuberance which accommodates a rod-shaped magnetic core. The metal body is present on the wall of this proturberance. The body is preferably disposed on the side of this wall facing the winding. The use of a separate insulation layer is then avoided. Generally, a sufficient amount of space is in fact present between the winding and the wall of the protuberance to provide the required insulation. Special steps to avoid attack by the discharge are not necessary either. The body is preferably in the form of a foil which is secured, for example by means of glue, to the said inner side. The electrical conductor, through which the body is connected to the lead-in conductors of the supply mains, also takes, for example, the form of a narrow strip which is secured to the wall of the protuberance. When the body is arranged on the side of the said protuberance facing the core, a separate lead-through member passing through the wall is not necessary.

The said body may consist of a conductive layer (such as indium oxide) or of a metal having favorable electrically conducting properties. It has been found that inter alia copper satisfies these requirements. Such a metal can moverover be provided in a simple manner as a foil on the wall.

The invention is preferably used in luminescent electrodeless low-pressure mercury vapor discharge lamps which serve as an alternative to incandescent lamps for general illumination purposes.

BRIEF DESCRIPTION OF THE DRAWING

The invention will now be described with reference to the drawing, which shows diagrammatically, partly in elevation and partly in sectional view, an embodiment of an electrodeless low-pressure mercury vapor discharge lamp according to the invention.

DETAILED DESCRIPTION OF THE INVENTION

The lamp shown comprises a glass lamp discharge vessel 1 which is sealed in a gas-tight manner and is filled with mercury and rare gas, such as argon and krypton, at a pressure of about 70 Pa. The inner wall of the lamp vessel is provided with a layer 2 of luminescent material. The lamp vessel is provided with a tubular protuberance 3 which accommodates a rod-shaped core 4 of magnetic material (ferrite). The core 4 is surrounded by a wire winding 5, which is connected by means of the connection wires 6 and 7 (partly visible) to a high-frequency supply unit located in a metal housing 8. During operation of the lamp, a magnetic field is induced in the core, while a discharge is produced in the lamp discharge vessel.

The housing 8 is situated in an envelope 9 of synthetic material, which is secured to the lamp vessel 1 and further carries the Edison lamp cap 10.

The winding 5 is surrounded by a thin-walled cylindrical metal body 11 which is interrupted at least at one area 11*a*, and is connected to the lamp cap 10 through the conductor 12. During operation of the lamp, the said body 11 is then connected to one of the lead-in wires of the supply mains. The body 11 is a copper foil which is secured on the side of the protuberance 3 facing the core 4 (for example by means of a heat-resistance glue). A sufficient amount of space is present between the said foil and the winding 5 to obtain a sufficient electrical insulation. In a practical embodiment, the foil is interrupted at one area in order to prevent that it from being heated during operation and to avoid ignition problems of the lamp. The length of the cylinder 11 constituted by the foil substantially corresponds to the length of the winding 5 and the lengths of the cylinder 11 and winding 5 are coextensive. With a length smaller than that of the winding, comparatively large interference currents have been measured in the supply mains. With a larger length, hardly any more suppression of the interference current was attained.

In a practical embodiment of the lamp described above, the diameter of the substantially spherical glass lamp vessel is about 70 mm. The lamp vessel contains mercury and a quantity of krypton at a pressure of about 70 Pa. The luminescent layer 2 comprises a mixture of two phosphors, i.e. green luminescing terbium-activated cerium magnesium aluminate and red luminescing yttrium oxide activated by trivalent europium. The magnetic core (length 50 mm, diameter about 8 mm) consists of ferrite (Philips 4C6). The winding 5 consists of twelve turns of copper wire (thickness 0.25 mm). The self-inductance of the coil thus formed is about 8 $\mu$H. The supply unit comprises a high-frequency oscillator having a frequency of about 2.65 MHz. The embodiment further comprises a transparent conductive layer located between the said luminescent layer 2 and the glass wall of the lamp vessel and consisting of fluorine-doped tin oxide. This layer is connected, like the metal housing 8, by means of a conductor to the lamp cap 10. The copper foil 11 (thickness 0.25 mm) forms a cylinder having a length of 12 mm. This length substantially corresponds to the length of the winding 5 (measured along its longitudinal axis). The foil has a resistance smaller than one ohm. At the operating frequency and this resistance value, the interference current is reduced to a comparatively low value. The suppression of the interference currents in the lamp was 10 dB ($\mu$V) (power supplied to the lamp inclusive of feeding 17 W, light output 1200 lumen), the ignition properties of the lamp not being influenced.

What is claimed is:

1. An electrodeless low-pressure discharge lamp comprising a glass lamp vessel which is sealed in a gas-tight manner and is filled with a metal vapor and a rare gas, this lamp being provided with a core of magnetic material, while during operation of the lamp an electric discharge is maintained in the lamp vessel by means of a wire winding connected to a high-frequency supply unit and arranged to surround the core, characterized in that the winding is surrounded in its immediate proximity by an thin-walled cylindrical metal body which is electrically insulated therefrom, is interrupted throughout its length at at least one area and is connected during operation of the lamp to one of the lead-in wires of the supply mains.

2. An electrodeless low-pressure discharge lamp as claimed in claim 1, characterized in that the length of the cylindrical metal body is substantially equal to the length of the winding.

3. An electrodeless lamp as claimed in claim 1, characterized in that the body is provided on the core at the area of the winding, while an electrically insulating layer is present between the body and the winding.

4. An electrodeless lamp as claimed in claim 1, in which the core is rod-shaped and is situated in a tubular protuberance in the wall of the lamp vessel, characterized in that the body is present on the side of the protuberance facing the winding.

5. An electrodeless lamp as claimed in claim 1, characterized in that the body consists of a metal foil.

6. An electrodeless lamp as claimed in claim 1, characterized in that the body comprises copper.

7. An electrodeless lamp as claimed in claim 2, characterized in that the body is provided on the core at the area of the winding, while an electrically insulating layer is present between the body and the winding.

8. An electrodeless lamp as claimed in claim 7, characterized in that the body consists of a metal foil.

9. An electrodeless lamp as claimed in claim 8, characterized in that the body comprises copper.

10. An electrodeless lamp as claimed in claim 2, in which the core is rod-shaped and is situated in a tubular protuberance in the wall of the lamp vessel, characterized in that the body is present on the side of the protuberance facing the winding.

11. An electrodeless lamp as claimed in claim 10, characterized in that the body consists of a metal foil.

12. An electrodeless lamp as claimed in claim 11, characterized in that the body comprises copper.

13. An electrodeless lamp as claimed in claim 2, characterized in that the body consists of a metal foil.

14. An electrodeless lamp as claimed in claim 13, characterized in that the body comprises copper.

15. An electrodeless lamp as claimed in claim 2, characterized in that the body comprises copper.

16. In an electrodeless fluorescent lamp having a sealed discharge vessel with a portion protruding inwardly of the vessel, a magnetic core disposed exterior to said discharge vessel within said protruding portion of said vessel, and a conductive winding wound around said magnetic core and energizable by a high-frequency signal for developing a field and maintaining a discharge within said vessel during lamp operation, the improvement comprising: a discontinuous conductive layer disposed opposite said winding and insulated from said winding, said discontinuous layer having an interruption extending in the length dimension of said winding along the entire length of said layer, and means for electrically connecting said conductive layer to power mains during lamp operation.

17. In a lamp according to claim 16, a lamp base comprising contacts for receiving a power mains voltage, and said means for electrically connecting said conductive layer to power mains comprising means for electrically connecting said conductive layer to a contact of said lamp base.

18. In a lamp according to claim 16, said conductive layer having a length substantially equal to the length of said winding, and said conductive layer positioned opposite said winding such that the respective lengths of said winding and conductive layer are coextensive.

19. In a lamp according to claim 17, said conductive layer having a length substantially equal to the length of said winding, and said conductive layer positioned opposite said winding such that the respective lengths of said winding and conductive layer are coextensive.

20. In a lamp according to claim 16, a high-frequency power supply connected to said winding for supplying an energizing signal having a frequency in the mega-Hertz range, and said conductive layer having a resistance no greater than about one ohm and being effective to reduce conducted interferences during lamp operation in the megaHertz range.

21. In a lamp according to claim 17, a high-frequency power supply connected to said winding for supplying an energizing signal having a frequency in the mega-Hertz range and connected to said lamp base contacts for receiving operating power from power mains, and said conductive layer having a resistance no greater than about one ohm and being effective to reduce conducted interference during lamp operation in the mega-Hertz range.

22. In a lamp according to claim 18, a high-frequency power supply connected to said winding for supplying an energizing signal having a frequency in the mega-Hertz range, and said conductive layer having a resistance no greater than about one ohm and being effective to reduce conducted interferences during lamp operation in the megaHertz range.

23. In a lamp according to claim 19, a high-frequency power supply connected to said winding for supplying an energizing signal having a frequency in the mega-Hertz range and connected to said lamp base contacts for receiving operating power from power mains, and said conductive layer having a resistance no greater than about one ohm and being effective to reduce conducted interference during lamp operation in the mega-Hertz range.

* * * * *